US012655757B2

(12) United States Patent
Nomura et al.

(10) Patent No.: US 12,655,757 B2
(45) Date of Patent: Jun. 16, 2026

(54) AUTOMATIC SUPPORT OF MULTIPLE TELEMETRY SYSTEMS IN WELLBORE WIRELINE COMMUNICATIONS

(71) Applicant: Schlumberger Technology Corporation, Sugar Land, TX (US)

(72) Inventors: Hiroshi Nomura, Sagamihara (JP); Adolfo Leon Recio, Clamart (FR); Nalin Weerasinghe, Sagamihara (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 55 days.

(21) Appl. No.: 18/931,428

(22) Filed: Oct. 30, 2024

(65) Prior Publication Data

US 2026/0117646 A1 Apr. 30, 2026

(51) Int. Cl.
*E21B 47/13* (2012.01)
*E21B 47/008* (2012.01)

(52) U.S. Cl.
CPC ..... *E21B 47/13* (2020.05); *E21B 47/008* (2020.05)

(58) Field of Classification Search
CPC ..... E21B 47/13; E21B 47/008
See application file for complete search history.

(56) References Cited

U.S. PATENT DOCUMENTS

| | | | | |
|---|---|---|---|---|
| 6,873,653 | B1 | 3/2005 | Rezvani | |
| 6,892,339 | B1 | 5/2005 | Polk, Jr. | |
| 7,787,525 | B1 | 8/2010 | Clark, Jr. | |
| 9,512,716 | B2 * | 12/2016 | Liu | H04W 52/367 |
| 9,982,528 | B2 | 5/2018 | Recio | |
| 2005/0285753 | A1 | 12/2005 | Shah | |
| 2016/0003035 | A1 * | 1/2016 | Logan | H04B 3/54 340/854.6 |
| 2019/0229767 | A1 | 7/2019 | Olson | |
| 2021/0087927 | A1 * | 3/2021 | Miller | E21B 47/18 |
| 2021/0238992 | A1 | 8/2021 | Zeng | |
| 2024/0368979 | A1 * | 11/2024 | Solem | E21B 44/00 |
| 2025/0308376 | A1 * | 10/2025 | Maclean | H04L 1/0002 |

FOREIGN PATENT DOCUMENTS

| | | | | |
|---|---|---|---|---|
| EP | 2876256 | A1 * | 5/2015 | H04B 11/00 |

* cited by examiner

*Primary Examiner* — Amine Benlagsir
(74) *Attorney, Agent, or Firm* — Jeffrey D. Frantz

(57) ABSTRACT

The present disclosure provides techniques and apparatus for automatic support of multiple telemetry systems in wellbore wireline communications. An example technique includes determining multiple telemetry protocols supported by the downhole telemetry module for communications with a surface acquisition module, and dynamically attempting to establish a communication session with the surface acquisition module using one or more of the telemetry protocols. Upon determining that an attempt with one of the telemetry protocols is successful, communications with the surface acquisition module are performed during the communication session using the telemetry protocol.

19 Claims, 4 Drawing Sheets

AUTOMATIC SUPPORT OF MULTIPLE TELEMETRY SYSTEMS IN WELLBORE WIRELINE COMMUNICATIONS

BACKGROUND

Field of the Disclosure

The present disclosure relates to wellbore telemetry systems. More specifically, the present disclosure provides techniques and apparatus for automatic support of multiple telemetry systems in wellbore wireline communications.

Description of Related Art

Hydrocarbon fluids, such as oil and natural gas, may be obtained from a subterranean geologic formation, referred to as a reservoir, by drilling a well that penetrates a hydrocarbon-bearing formation. A variety of downhole tools may be used in various areas of oil and natural gas services. In some cases, downhole tools may be used in a well for surveying, drilling, and production of hydrocarbons. The downhole tools may communicate with the surface via various telemetry systems. In some cases, the downhole tools may include one or more individual modules in operative communication with one another, such as a primary module and multiple secondary modules.

Although wellbore telemetry systems have made technological advancements over many years, there is a continuous desire to improve the technical performance of wellbore telemetry systems, including, for example: improving speed and data carrying capacity of communications, improving efficiency of the use of communication mediums, improving reliability of communications, and the like. Consequently, there exists a need for further improvements in wellbore telemetry systems.

SUMMARY

One embodiment of the present disclosure described herein is a method performed by a downhole telemetry module. The method includes determining a plurality of telemetry protocols supported by the downhole telemetry module for communications with a surface acquisition module. The method also includes dynamically attempting to establish a communication session with the surface acquisition module using one or more of the plurality of telemetry protocols. The method further includes, upon determining that an attempt with one of the plurality of telemetry protocols is successful, performing communications with the surface acquisition module during the communication session using the one of the plurality of telemetry protocols.

Another embodiment of the present disclosure described herein is a downhole telemetry module. The downhole telemetry module includes one or more memories collectively storing instructions, and one or more processors communicatively coupled to the one or more memories. The one or more processors are collectively configured to execute the instructions to cause the downhole telemetry module to: determine a plurality of telemetry protocols supported by the downhole telemetry module for communications with a surface acquisition module; dynamically attempt to establish a communication session with the surface acquisition module using one or more of the plurality of telemetry protocols; and upon determining that an attempt with one of the plurality of telemetry protocols is successful, perform communications with the surface acquisition module during the communication session using the one of the plurality of telemetry protocols.

Another embodiment of the present disclosure is a non-transitory computer-readable storage medium. The non-transitory computer-readable storage medium includes computer-executable code, which when executed by one or more processors of a downhole telemetry module, perform an operation. The operation includes determining a plurality of telemetry protocols supported by the downhole telemetry module for communications with a surface acquisition module. The operation also includes dynamically attempting to establish a communication session with the surface acquisition module using one or more of the plurality of telemetry protocols. The operation further includes, upon determining that an attempt with one of the plurality of telemetry protocols is successful, performing communications with the surface acquisition module during the communication session using the one of the plurality of telemetry protocols.

The following description and the appended figures set forth certain features for purposes of illustration.

BRIEF DESCRIPTION OF DRAWINGS

Various embodiments in accordance with the present disclosure will be described with reference to the drawings, where like designations denote like elements. Note that the appended drawings illustrate typical embodiments and are therefore not to be considered limiting; other equally effective embodiments are contemplated.

DETAILED DESCRIPTION

Figure 1:
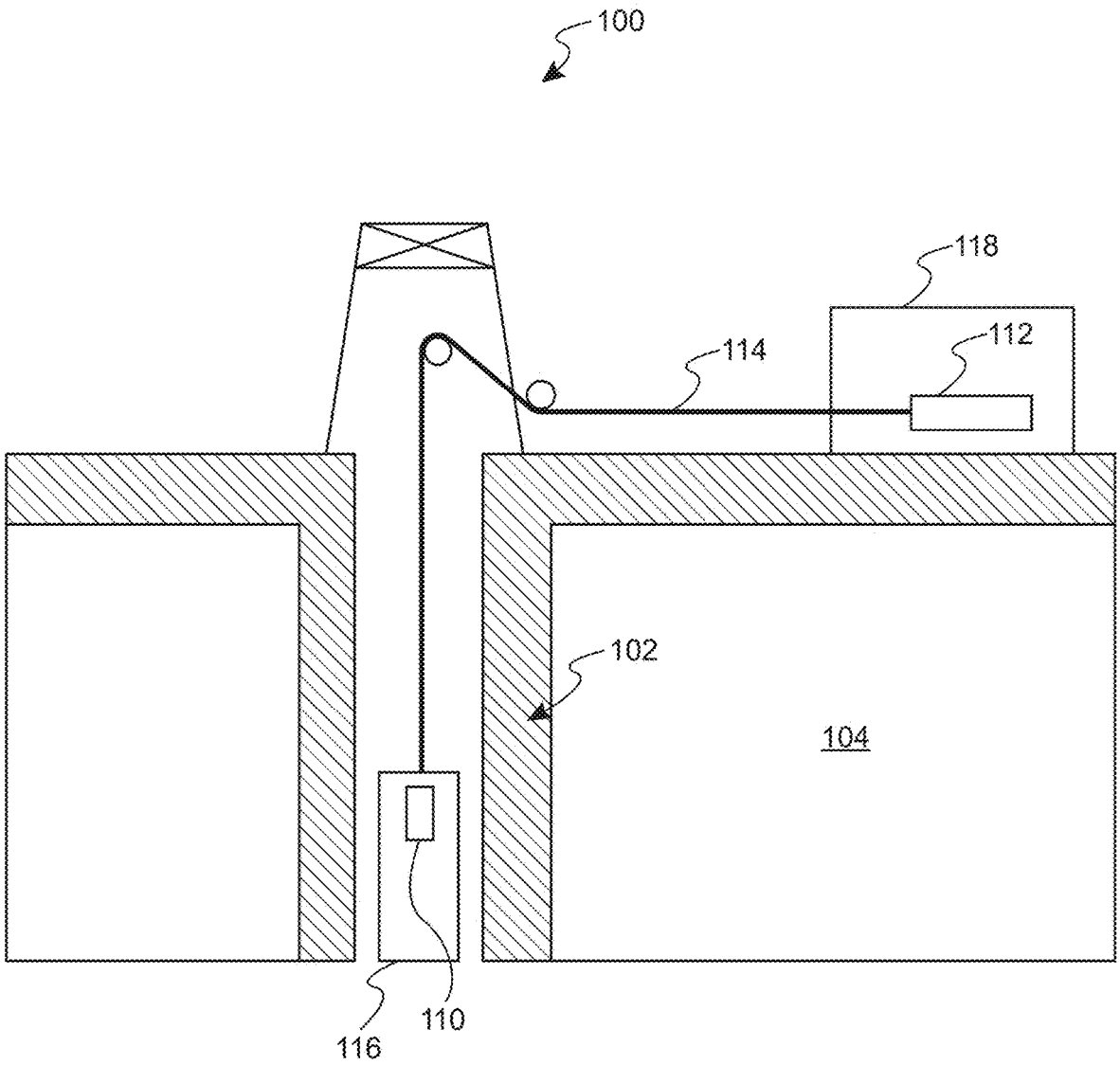
FIG. 1 is a schematic diagram of an example system, according to certain embodiments.

As wellbore telemetry systems continue to evolve to support increasing data rates and to achieve higher performance, reliability and durability for wireline telemetry sessions, there is an ever increasing number of "newer" telemetry systems being developed with enhanced capabilities compared to "legacy" telemetry systems. By way of example, certain "newer" telemetry systems may support telemetry protocols that allow for higher speed communications during a telemetry session between downhole telemetry equipment and surface acquisition equipment compared to "legacy" telemetry systems. In another illustrative example, "newer" telemetry systems may support telemetry protocols that are more robust and tolerant to communication errors that may occur within a telemetry session compared to "legacy" telemetry systems.

However, as the number of telemetry systems continues to increase, it is becoming increasingly difficult to update, retrofit, and/or configure existing wellsites to support such telemetry systems. For example, for surface acquisition modules equipped with legacy telemetry systems, it may be impractical (or, in some cases, impossible) to retrofit such surface acquisition modules to support newer telemetry systems.

The present disclosure provides techniques, methods, systems, apparatus, and computer readable media for automatic support of multiple telemetry systems in wellbore wireline communications. As described below, in certain scenarios, a downhole telemetry module may support multiple telemetry systems for communications with a surface acquisition module, whereas the surface acquisition module may support only one of the multiple telemetry systems. Each telemetry system may use a respective one or more telemetry protocols for uplink and downlink communications with the surface acquisition module. In such scenarios, the downhole telemetry module may be unaware of which one of the multiple telemetry systems is supported by the surface acquisition module.

In certain embodiments, the downhole telemetry module may dynamically attempt multiple communication attempts with the surface acquisition module to perform communications with the surface acquisition module using each of the telemetry protocols. In scenarios where the surface acquisition module supports only one of the multiple telemetry systems/protocols, the surface acquisition module may respond to a communication attempt from the downhole telemetry module when the communication attempt is performed using the telemetry protocol supported by the surface acquisition module, and may refrain from responding to other communication attempts from the downhole telemetry modules that are performed using other telemetry protocols that are not supported by the surface acquisition module. Once the downhole telemetry module determines that a communication attempt with one of the telemetry protocols is successful, the downhole telemetry module may perform communications with the surface acquisition module during a communication session with the successful telemetry protocol.

The techniques, methods, systems, apparatus, and computer readable media for automatic support of multiple telemetry systems in wellbore wireline communications may provide various advantages. For example, the techniques described herein may allow operators to deploy newer downhole telemetry modules at field locations that have existing legacy surface acquisition modules. Doing so may allow operators to migrate downhole telemetry modules to new hardware assets while maintaining compatibility with legacy surface acquisition modules.

The following description includes embodiments of the best mode presently contemplated for practicing the described implementations. This description is not to be taken in a limiting sense, but rather is made merely for the purpose of describing the general principles of the implementations. The scope of the described implementations should be ascertained with reference to the issued claims.

Although the terms "first," "second," "third," etc., may be used herein to describe various elements, components, regions, layers and/or sections, these elements, components, regions, layers and/or sections should not be limited by these terms. These terms may be only used to distinguish one element, component, region, layer or section from another element, component, region, layer, or section. Terms such as "first," "second," and other numerical terms, when used herein, do not imply a sequence or order unless clearly indicated by the context. Thus, a first element, component, region, layer, or section discussed herein could be termed a second element, component, region, layer, or section without departing from the teachings of the example embodiments.

As used herein, a hyphenated form of a reference numeral refers to a specific instance of an element and the unhyphenated form of the reference numeral refers to the collective element. Thus, for example, device "12-1" refers to an instance of a device class, which may be referred to collectively as devices "12" and any one of which may be referred to generically as a device "12".

Example System for Automatic Support of Multiple Telemetry Systems

FIG. 1 is a schematic diagram of at least a portion of an example implementation of a wellsite system 100 that can be configured to perform automatic support of multiple telemetry systems, according to various embodiments. In FIG. 1, an example wireline logging operation is illustrated with respect to the wellsite system 100. The wellsite system 100 is deployed in a wellbore 102 traversing a subsurface formation 104. A downhole telemetry module 110 (also referred to as a downhole telemetry equipment, a downhole telemetry system, or a downhole telemetry cartridge) is connected to a toolstring 116. In a well-logging operation, one or more tools may be connected to, included within, or otherwise coupled to the toolstring 116. The tools of the toolstring 116 may communicate with downhole telemetry circuits of the downhole telemetry module 110 via a bi-directional electrical interface.

In certain embodiments, the tool(s) of the toolstring 116 may be connected to the downhole telemetry module 110 over a common data bus. In certain other embodiments, each tool of the toolstring 116 may be individually, directly connected to the downhole telemetry module 110. In one embodiment, the downhole telemetry module 110 may be a separate unit, which is mechanically and electrically connected to the tools in the toolstring 116. In one embodiment, the downhole telemetry module 110 may be integrated into a housing of one of the tools of the toolstring 116.

The downhole telemetry module 110 is operatively coupled to the wireline cable 114. The tools of the toolstring 116, including the downhole telemetry module 110, may be lowered into the wellbore 102 on the wireline cable 114. The wireline cable 114 may be a monocable, coaxial cable, or a multi-conductor cable, such as a heptacable.

A surface acquisition module 118 is located at the surface end of the wireline cable 114. The surface acquisition module 118 includes or couples to a telemetry unit 112 (also referred to as a telemetry module or telemetry interface module). The surface acquisition module 118 may provide control of the components in the toolstring 116 and process and store the data acquired downhole. The surface acquisition module 118 may communicate with the telemetry unit 112 via a bi-directional electrical interface.

The telemetry unit 112 may modulate downlink data (e.g., commands) from the surface acquisition module 118 for transmission via the wireline cable 114 to the toolstring 116, and demodulates uplink data received via the wireline cable 114 from the toolstring 116 for processing and storage by the surface acquisition module 118. The telemetry unit 112 may use a telemetry protocol for uplink and downlink communications with the downhole telemetry module 110. In certain embodiments, the telemetry unit 112 supports a single telemetry protocol. In other certain embodiments, the telemetry unit 112 supports multiple telemetry protocols.

The downhole telemetry module 110 includes circuitry to modulate uplink data from the tools of the toolstring 116 for transmission via the wireline cable 114 to the surface acquisition module 118. The downhole telemetry module 110 also includes circuitry to demodulate downlink commands or data from the surface acquisition module 118 for the tools of the toolstring 116. The downhole telemetry module 110 may use a telemetry protocol for uplink and downlink communications with the telemetry unit 112 of the surface acquisition module 118. In certain embodiments, the downhole telemetry module 110 may support one or more telemetry protocols for communications with the surface acquisition module 118.

As noted, in certain cases, once a surface acquisition module 118 has been configured to use a particular telemetry system/telemetry protocol for communications with a downhole telemetry module 110, it may be difficult (and, in some cases, impossible) for operators to retrofit and/or update the surface acquisition module 118 to support a different (e.g., newer) telemetry system/telemetry protocol. In such cases, it may be difficult for operators to use updated hardware for downhole telemetry modules for existing wellsites, since such downhole telemetry modules would not be able to perform communications with the surface acquisition modules at the existing wellsites.

As such, certain embodiments described herein enable a wellsite system 100 to support multiple telemetry systems for communications between a downhole telemetry module 110 and a surface acquisition module 118. In certain embodiments, the downhole telemetry module 110 supports multiple different telemetry systems/protocols, whereas the surface acquisition module 118 is configured to support one of the telemetry systems/protocols during a telemetry session (also referred to as a "run"). In such embodiments, the downhole telemetry module 110 may be unaware of which of the telemetry systems/protocols is supported by the surface acquisition module 118.

Accordingly, in certain embodiments, the downhole telemetry module 110 is configured to dynamically attempt to establish a telemetry session (e.g., communication session) with the surface acquisition module 118 using one or more telemetry protocols. That is, the downhole telemetry module 110 can dynamically attempt each of the telemetry protocols supported by the downhole telemetry module 110 until the downhole telemetry module 110 determines which of the telemetry protocols is supported by the surface acquisition module 118. Upon determining that an attempt with one of the telemetry protocols is successful, the downhole telemetry module 110 may communicate with the surface acquisition module 118 during the telemetry session using the successful telemetry protocol.

In certain embodiments, the downhole telemetry module 110 may determine that a communication attempt with one of the telemetry protocols is successful when the downhole telemetry module 110 detects a response from the surface acquisition module 118 to the communication attempt with the telemetry protocol. For example, the surface acquisition module 118 may be configured to respond to a communication attempt that uses a telemetry protocol supported by the surface acquisition module 118, and the surface acquisition module 118 may be configured to refrain from responding to a communication attempt that uses a telemetry protocol that is not supported by the surface acquisition module 118. In some examples, the communication attempt by the downhole telemetry module 110 may involve sending a telemetry initiation command to the surface acquisition module 118 using one of the telemetry protocols supported by the downhole telemetry module 110. The surface acquisition module 118 may be configured to automatically respond to the telemetry initiation command when the telemetry initiation command is sent using a telemetry protocol that is also supported by the surface acquisition module 118. Additionally, the downhole telemetry module 110 may determine that a communication attempt with one of the telemetry protocols is successful when the response from the surface acquisition module 118 is received within a predetermined amount of time (e.g., timeout) after the initiation of the attempt or within a predetermined number of attempts to establish the telemetry session with the telemetry protocol.

Figure 2:
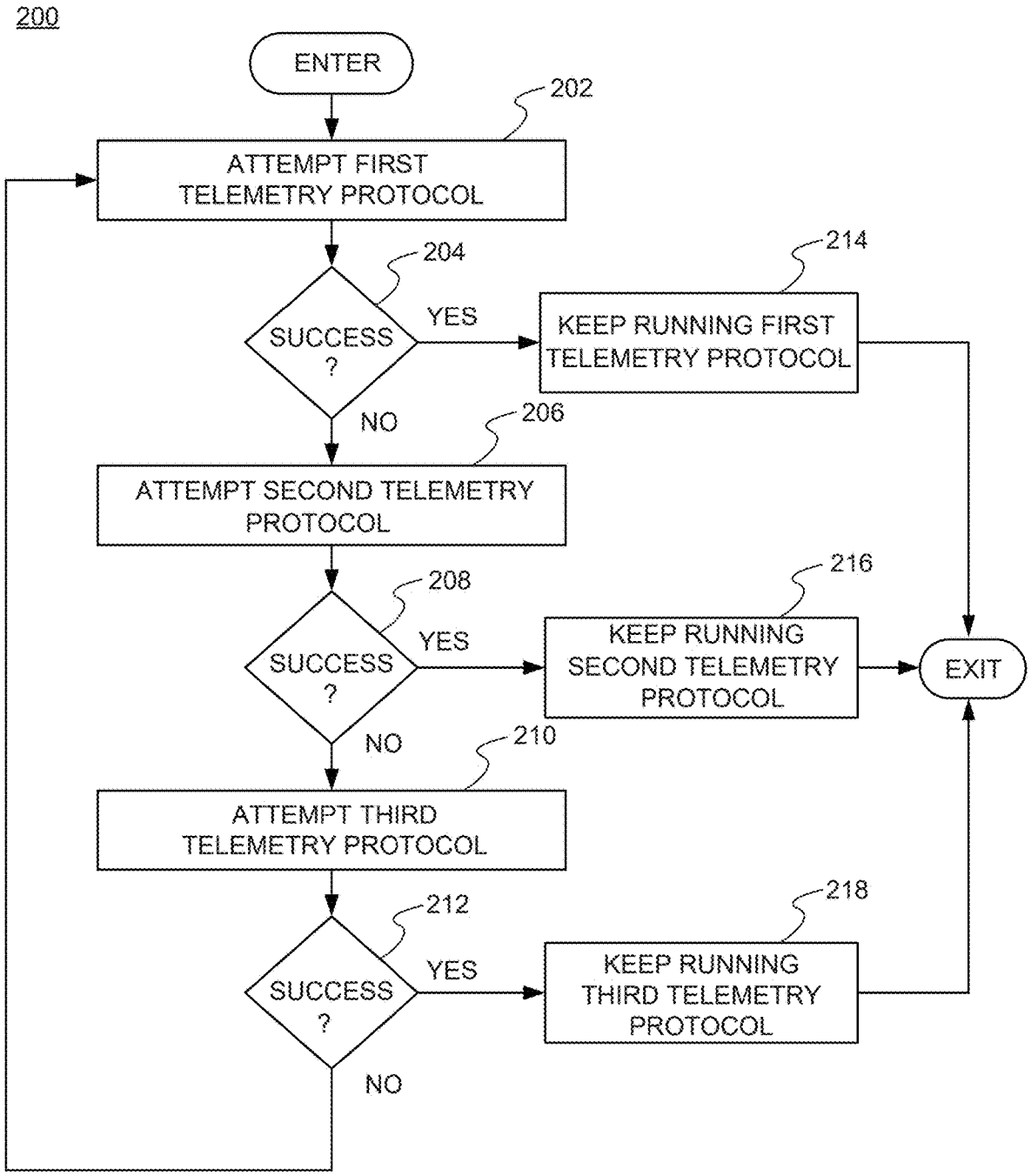
FIG. 2 is a flowchart of an example method for automatic support of multiple telemetry protocols, according to certain embodiments.

FIG. 2 is a flowchart of an example method 200 for automatic support of multiple telemetry protocols, according to certain embodiments. The method 200 may be performed by a downhole telemetry module (e.g., downhole telemetry module 110). For the sake of clarity, FIG. 2 depicts an illustrative example in which the downhole telemetry module supports and attempts three different telemetry protocols. However, it should be understood that the techniques described herein can be used for any number of telemetry protocols supported by a downhole telemetry module.

Method 200 may enter at block 202, where the downhole telemetry module attempts to establish a telemetry session with a surface acquisition module (e.g., surface acquisition module 118) using a first telemetry protocol.

At block 204, the downhole telemetry module determines whether the attempt in block 202 is successful. If so, then the method 200 proceeds to block 214. If not, then the method proceeds to block 206. In certain embodiments, the downhole telemetry module may determine the attempt at block 204 is successful when at least one of: (i) a response is received from the surface acquisition module within a predetermined amount of time after initiation of the attempt or (ii) a response is received from the surface acquisition module within a predetermined number of retries of the attempt.

At block 206, the downhole telemetry module attempts to establish a telemetry session with the surface acquisition module using a second telemetry protocol different from the first telemetry protocol.

At block 208, the downhole telemetry module determines whether the attempt in block 206 is successful. If so, then the method 200 proceeds to block 216. If not, then the method proceeds to block 210. In certain embodiments, the downhole telemetry module may determine the attempt at block 208 is successful when at least one of: (i) a response is received from the surface acquisition module within a predetermined amount of time after initiation of the attempt or (ii) a response is received from the surface acquisition module within a predetermined number of retries of the attempt.

At block 210, the downhole telemetry module attempts to establish a telemetry session with the surface acquisition module using a third telemetry protocol different from the first telemetry protocol and the second telemetry protocol.

At block 212, the downhole telemetry module determines whether the attempt in block 210 is successful. If so, then the method 200 proceeds to block 218. If not, then the method proceeds to block 202. In certain embodiments, the downhole telemetry module may determine the attempt at block 212 is successful when at least one of: (i) a response is received from the surface acquisition module within a predetermined amount of time after initiation of the attempt or (ii) a response is received from the surface acquisition module within a predetermined number of retries of the attempt.

At block 214, the downhole telemetry module keeps running the first telemetry protocol for a duration of the telemetry session. At block 216, the downhole telemetry module keeps running the second telemetry protocol for a duration of the telemetry session. At block 218, the downhole telemetry module keeps running the third telemetry protocol for a duration of the telemetry session.

In certain embodiments, after the downhole telemetry module reaches the end of the telemetry protocol list, the downhole telemetry module may restart the process of attempting to establish a telemetry session starting with the first telemetry protocol (e.g., block 202).

Example Operations

Figure 3:
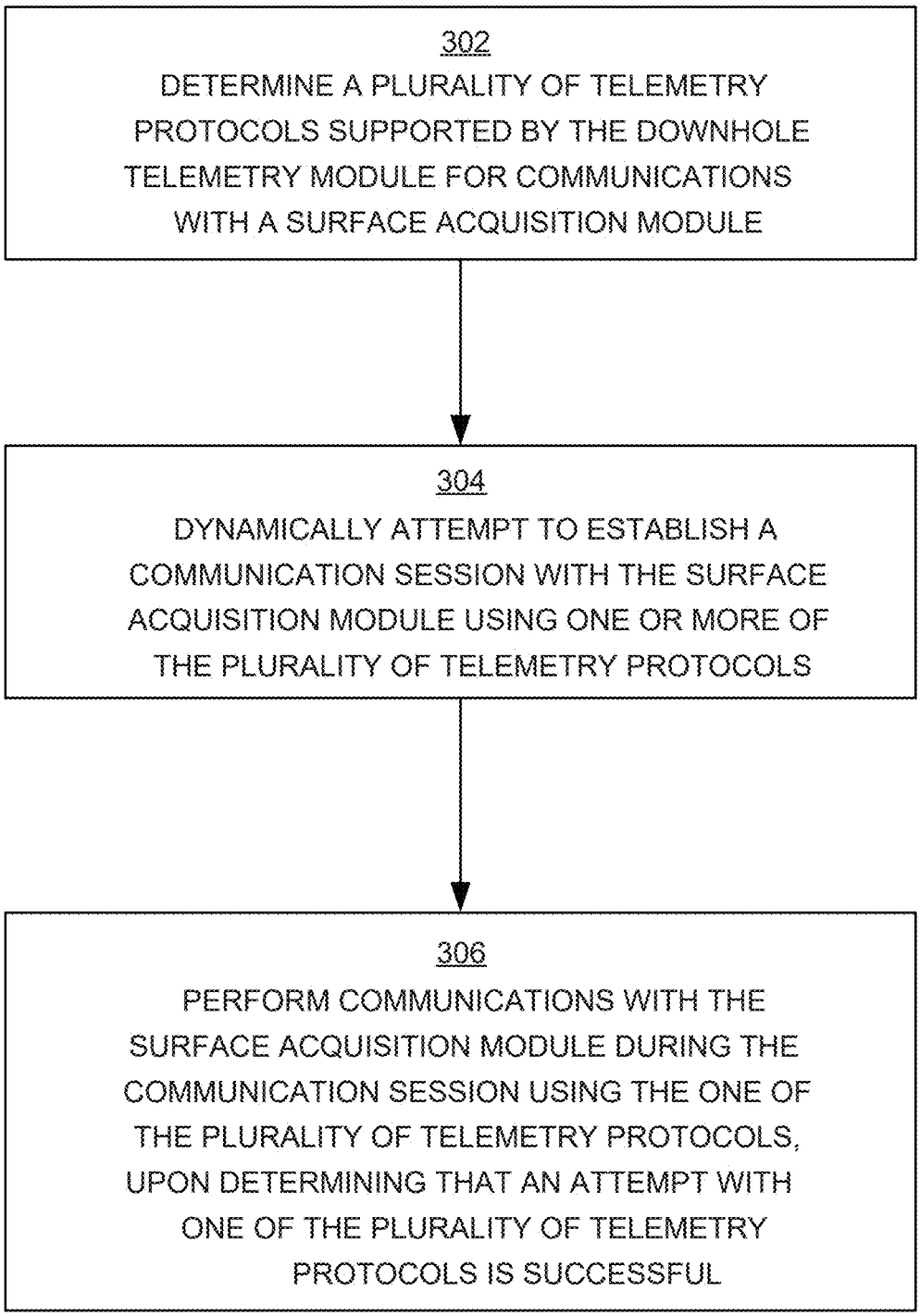
FIG. 3 is a flow diagram depicting example operations for automatic support of multiple telemetry protocols, according to certain embodiments.

FIG. 3 is a flow diagram depicting an example operations 300 for automatic support of multiple telemetry systems, according to various embodiments. The operations 300 may be performed, for example, by a downhole telemetry module (e.g., downhole telemetry module 110).

The operations 300 may involve, at block 302, determining a plurality of telemetry protocols supported by the downhole telemetry module for communications with a surface acquisition module (e.g., surface acquisition module 118).

The operations 300 may also involve, at block 304, dynamically attempting to establish a communication session (e.g., telemetry session) with the surface acquisition module using one or more of the plurality of telemetry protocols.

The operations 300 may further involve, at block 306, performing communications with the surface acquisition module during the communication session using the one of the plurality of telemetry protocols, upon determining that an attempt with one of the plurality of telemetry protocols is successful.

In certain embodiments, determining that the attempt with the one of the plurality of telemetry protocols is successful includes receiving a response from the surface acquisition module within a predefined amount of time after initiation of the attempt, prior to a threshold number of retries of the attempt, or a combination thereof.

In certain embodiments, the surface acquisition module supports the one of the plurality of telemetry protocols and lacks support for each other telemetry protocol of the plurality of telemetry protocols.

In certain embodiments, the downhole telemetry module lacks knowledge of which of the plurality of telemetry protocols is supported by the surface acquisition module.

In certain embodiments, the communications are performed using the one of the plurality of telemetry protocols for a duration of the communication session.

In certain embodiments, dynamically attempting to establish the communication session includes: (i) performing a first attempt to establish the communication session using a first telemetry protocol of the plurality of telemetry protocols; and (ii) after performing the first attempt, performing a second attempt to establish the communication session using a second telemetry protocol of the plurality of telemetry protocols.

In certain embodiments, dynamically attempting to establish the communication session includes determining that the first attempt is unsuccessful. In such embodiments, the second attempt is performed in response to determining that the first attempt is unsuccessful. Determining that the first attempt is unsuccessful includes at least one of: (i) detecting a timeout after an initiation of the first attempt or (ii) determining that a number of retries of the first attempt is greater than a threshold.

In certain embodiments, dynamically attempting to establish the communication session further includes, after performing the second attempt and in response to determining that the second attempt is unsuccessful, performing a third attempt to establish the communication session using a third telemetry protocol of the plurality of telemetry protocols.

In certain embodiments, dynamically attempting to establish the communication session further includes, after performing the third attempt and in response to determining that the third attempt is unsuccessful, re-performing the first attempt to establish the communication session using the first telemetry protocol.

Example Computing Device

Figure 4:
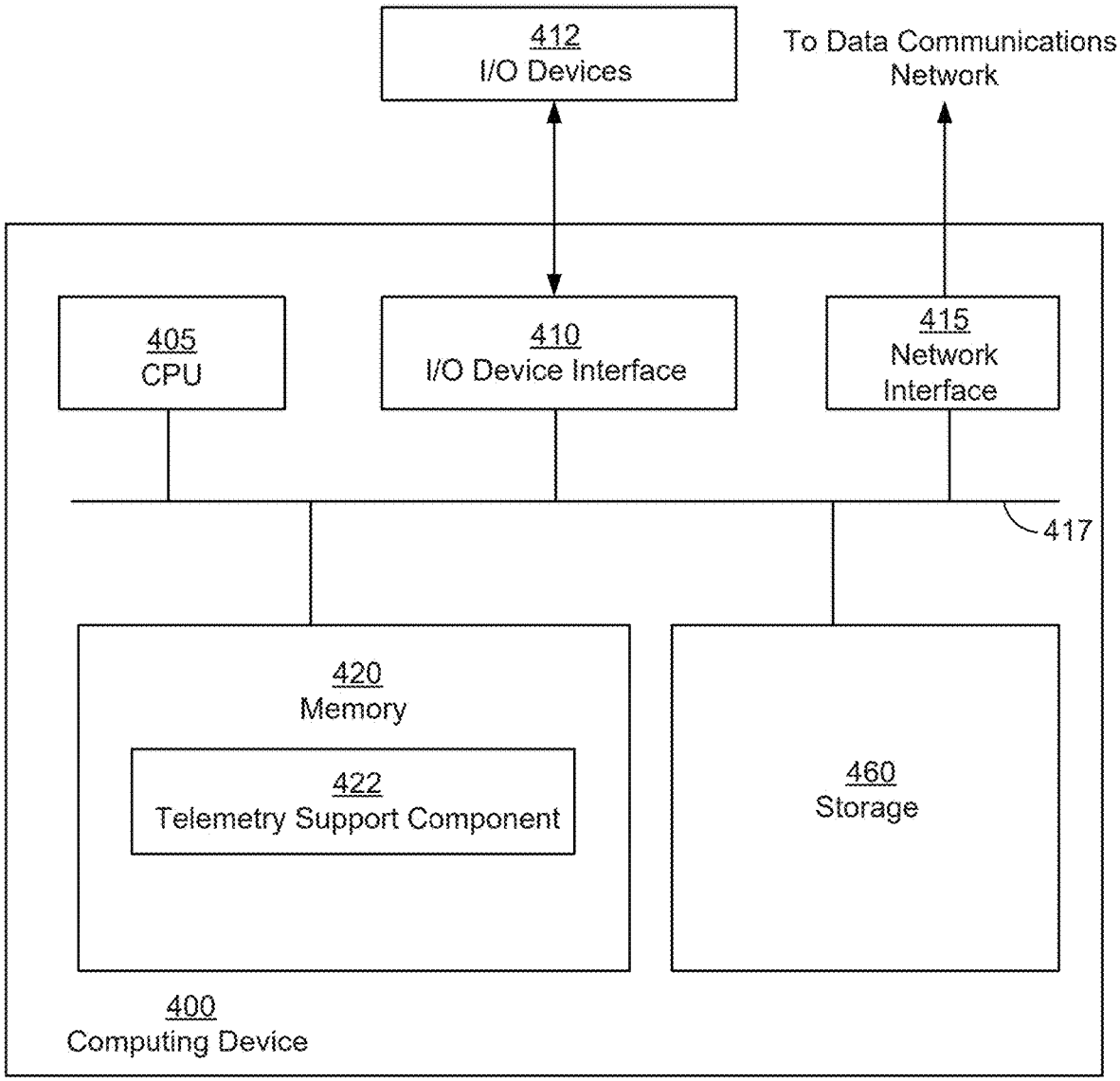
FIG. 4 depicts an example computing device, according to certain embodiments.

FIG. 4 illustrates an example computing device 400 configured to perform automatic support of multiple telemetry systems, according to various embodiments. In certain embodiments, the computing device 400 may be configured to perform method 200 illustrated in FIG. 2, operations 300 illustrated in FIG. 3, or any other technique or combination of techniques described herein. In certain embodiments, the computing device 400 is representative of a downhole telemetry module (e.g., downhole telemetry module 110).

As shown, the computing device 400 includes, without limitation, a central processing unit (CPU) 405, a network interface 415, a memory 420, and storage 460, each connected to a bus 417. The computing device 400 may also include an input/output (I/O) device interface 410 connecting I/O devices 412 (e.g., keyboard, display and mouse devices) to the computing device 400. The computing device 400 is generally under the control of an operating system (not shown).

The CPU 405 retrieves and executes programming instructions stored in the memory 420 as well as stored in the storage 460. The bus 417 is used to transmit programming instructions and application data between the CPU 405, I/O device interface 410, storage 460, network interface 415, and memory 420. Note, CPU 405 is included to be representative of a single CPU, multiple CPUs, a single CPU having multiple processing cores, and the like, and the memory 420 is generally included to be representative of a random access memory. The storage 460 may be a disk drive or flash storage device. Although shown as a single unit, the storage 460 may be a combination of fixed and/or removable storage devices, such as fixed disc drives, removable memory cards, optical storage, network attached storage (NAS), or a storage area-network (SAN).

Illustratively, the memory 420 includes a telemetry support component 422, which is configured to perform method 200 illustrated in FIG. 2, operations 300 illustrated in FIG. 3, or any other technique (or combination of techniques) described herein. Note, while FIG. 4 depicts the telemetry support component 422 within memory 420, which is generally representative of volatile memory (e.g., random access memory), in certain embodiments, the telemetry support component 422 is included in persistent (e.g., non-volatile) memory or persistent (e.g., non-volatile) storage, such as storage 460 of FIG. 4.

Example Clauses

Implementation examples are described in the following numbered clauses:

Clause 1: A method performed by a downhole telemetry module, comprising: determining a plurality of telemetry protocols supported by the downhole telemetry module for communications with a surface acquisition module; dynamically attempting to establish a communication session with the surface acquisition module using one or more of the plurality of telemetry protocols; and upon determining that an attempt with one of the plurality of telemetry protocols is successful, performing communications with the surface acquisition module during the communication session using the one of the plurality of telemetry protocols.

Clause 2: The method of Clause 1, wherein determining that the attempt with the one of the plurality of telemetry protocols is successful comprises receiving a response from the surface acquisition module within a predefined amount of time after initiation of the attempt, prior to a threshold number of retries of the attempt, or a combination thereof.

Clause 3: The method according to any of Clauses 1-2, wherein the surface acquisition module supports the one of the plurality of telemetry protocols and lacks support for each other telemetry protocol of the plurality of telemetry protocols.

Clause 4: The method according to any of Clauses 1-3, wherein the downhole telemetry module lacks knowledge of which of the plurality of telemetry protocols is supported by the surface acquisition module.

Clause 5: The method according to any of Clauses 1-4, wherein the communications are performed using the one of the plurality of telemetry protocols for a duration of the communication session.

Clause 6: The method according to any of Clauses 1-5, wherein dynamically attempting to establish the communication session comprises: performing a first attempt to establish the communication session using a first telemetry protocol of the plurality of telemetry protocols; and after performing the first attempt, performing a second attempt to establish the communication session using a second telemetry protocol of the plurality of telemetry protocols.

Clause 7: The method of Clause 6, wherein: dynamically attempting to establish the communication session comprises determining that the first attempt is unsuccessful; and the second attempt is performed in response to determining that the first attempt is unsuccessful.

Clause 8: The method of Clause 7, wherein determining that the first attempt is unsuccessful comprises at least one of (i) detecting a timeout after an initiation of the first attempt or (ii) determining that a number of retries of the first attempt is greater than a threshold.

Clause 9: The method according to any of Clauses 6-8, wherein dynamically attempting to establish the communication session further comprises, after performing the second attempt and in response to determining that the second attempt is unsuccessful, performing a third attempt to establish the communication session using a third telemetry protocol of the plurality of telemetry protocols.

Clause 10: The method of Clause 9, wherein dynamically attempting to establish the communication session further comprises, after performing the third attempt and in response to determining that the third attempt is unsuccessful, re-performing the first attempt to establish the communication session using the first telemetry protocol.

Clause 11: A downhole telemetry module comprising: one or more memories collectively storing instructions; and one or more processors communicatively coupled to the one or more memories, the one or more processors being collectively configured to execute the instructions to cause the downhole telemetry module to: determine a plurality of telemetry protocols supported by the downhole telemetry module for communications with a surface acquisition module; dynamically attempt to establish a communication session with the surface acquisition module using one or more of the plurality of telemetry protocols; and upon determining that an attempt with one of the plurality of telemetry protocols is successful, perform communications with the surface acquisition module during the communication session using the one of the plurality of telemetry protocols.

Clause 12: The downhole telemetry module of Clause 11, wherein to determine that the attempt with the one of the plurality of telemetry protocols is successful, the one or more processors are configured to execute the instructions to cause the downhole telemetry module to receive a response from the surface acquisition module within a predefined amount of time after initiation of the attempt, prior to a threshold number of retries of the attempt, or a combination thereof.

Clause 13: The downhole telemetry module according to any of Clauses 11-12, wherein the surface acquisition module supports the one of the plurality of telemetry protocols and lacks support for each other telemetry protocol of the plurality of telemetry protocols.

Clause 14: The downhole telemetry module according to any of Clauses 11-13, wherein the downhole telemetry module lacks knowledge of which of the plurality of telemetry protocols is supported by the surface acquisition module.

Clause 15: The downhole telemetry module according to any of Clauses 11-14, wherein the communications are performed using the one of the plurality of telemetry protocols for a duration of the communication session.

Clause 16: The downhole telemetry module according to any of Clauses 11-15, wherein to dynamically attempt to establish the communication session, the one or more processors are configured to execute the instructions to cause the downhole telemetry module to: perform a first attempt to establish the communication session using a first telemetry protocol of the plurality of telemetry protocols; and after performing the first attempt, perform a second attempt to establish the communication session using a second telemetry protocol of the plurality of telemetry protocols.

Clause 17: The downhole telemetry module of Clause 16, wherein: to dynamically attempt to establish the communication session, the one or more processors are configured to execute the instructions to cause the downhole telemetry module to determine that the first attempt is unsuccessful; and the second attempt is performed in response to determining that the first attempt is unsuccessful.

Clause 18: The downhole telemetry module of Clause 17, wherein to determine that the first attempt is unsuccessful, the one or more processors are configured to execute the instructions to cause the downhole telemetry module to at least one of (i) detect a timeout after an initiation of the first attempt or (ii) determine that a number of retries of the first attempt is greater than a threshold.

Clause 19: The downhole telemetry module according to any of Clauses 16-18, wherein to dynamically attempt to establish the communication session, the one or more processors are further configured to execute the instructions to cause the downhole telemetry module to, after performing the second attempt and in response to determining that the second attempt is unsuccessful, perform a third attempt to establish the communication session using a third telemetry protocol of the plurality of telemetry protocols.

Clause 20: The downhole telemetry module of Clause 19, wherein to dynamically attempt to establish the communication session, the one or more processors are further configured to execute the instructions to cause the downhole telemetry module to, after performing the third attempt and in response to determining that the third attempt is unsuccessful, re-perform the first attempt to establish the communication session using the first telemetry protocol.

Clause 21: A non-transitory computer-readable storage medium comprising computer-executable code, which when executed by one or more processors of a downhole telemetry module, perform a method in accordance with any of Clauses 1-10.

Clause 22: An apparatus comprising means for performing a method in accordance with any of Clauses 1-10.

Clause 23: An apparatus comprising: one or more memories collectively storing computer-executable instructions, and one or more processors coupled to the one or more memories, the one or more processors being collectively configured to execute the computer-executable instructions to cause the apparatus to perform a method in accordance with any of Clauses 1-10.

Additional Considerations

The preceding description is provided to enable any person skilled in the art to practice the various aspects described herein. The examples discussed herein are not limiting of the scope, applicability, or aspects set forth in the claims. Various modifications to these aspects will be readily apparent to those skilled in the art, and the general principles defined herein may be applied to other aspects. For example, changes may be made in the function and arrangement of elements discussed without departing from the scope of the disclosure. Various examples may omit, substitute, or add various procedures or components as appropriate. For instance, the methods described may be performed in an order different from that described, and various actions may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim.

The various illustrative logical blocks, modules and circuits described in connection with the present disclosure may be implemented or performed with a general purpose processor, a digital signal processor (DSP), an application specific integrated circuit (ASIC), a field programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any commercially available processor, controller, microcontroller, or state machine. A processor may also be implemented as a combination of computing devices, e.g., a combination of a DSP and a microprocessor, a plurality of microprocessors, one or more microprocessors in conjunction with a DSP core, a system on a chip (SoC), or any other such configuration.

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

As used herein, "a processor," "at least one processor," or "one or more processors" generally refer to a single processor configured to perform one or multiple operations or multiple processors configured to collectively perform one or more operations. In the case of multiple processors, performance of the one or more operations could be divided amongst different processors, though one processor may perform multiple operations, and multiple processors could collectively perform a single operation. Similarly, "a memory," "at least one memory," or "one or more memories" generally refer to a single memory configured to store data and/or instructions or multiple memories configured to collectively store data and/or instructions.

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. Also, "determining" may include resolving, selecting, choosing, establishing and the like.

The methods disclosed herein comprise one or more actions for achieving the methods. The method actions may be interchanged with one another without departing from the scope of the claims. In other words, unless a specific order of actions is specified, the order and/or use of specific actions may be modified without departing from the scope of the claims. Further, the various operations of methods described above may be performed by any suitable means capable of performing the corresponding functions. The means may include various hardware and/or software component(s) and/or module(s), including, but not limited to a circuit, an ASIC, or processor.

The following claims are not intended to be limited to the aspects shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S. C. § 112(f) unless the element is expressly recited using the phrase "means for". All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

The invention claimed is:

1. A method performed by a downhole telemetry module, comprising:

determining a plurality of telemetry protocols supported by the downhole telemetry module for communications with a surface acquisition module;

without prior knowledge of which telemetry protocol of the plurality of telemetry protocols is supported by the surface acquisition module, dynamically attempting to establish a communication session with the surface acquisition module using one or more of the plurality of telemetry protocols by sequentially transmitting a telemetry initiation message using each telemetry protocol of the plurality of telemetry protocols;

determining, for each telemetry protocol, that the a first telemetry protocol is unsupported based on an expiration of a predefined timeout without receiving a response from the surface acquisition module prior to transmitting the telemetry initiation message using a next telemetry protocol, wherein the surface acquisition module responds to second communication attempts performed using a second telemetry protocol supported by the surface acquisition module and refrains from responding to first communication attempts performed using unsupported telemetry protocols; and upon determining that an attempt with one of the plurality of telemetry protocols is successful, performing the communications with the surface acquisition module during the communication session using the one of the plurality of telemetry protocols.

2. The method of claim 1, wherein determining that the attempt with the one of the plurality of telemetry protocols is successful comprises receiving the response from the surface acquisition module within a predefined amount of time after initiation of the attempt, prior to a threshold number of retries of the attempt, or a combination thereof.

3. The method of claim 2, wherein the surface acquisition module supports the one of the plurality of telemetry protocols and lacks support for each other telemetry protocol of the plurality of telemetry protocols.

4. The method of claim 1, wherein the communications are performed using the one of the plurality of telemetry protocols for a duration of the communication session.

5. The method of claim 1, wherein dynamically attempting to establish the communication session comprises:

performing a first attempt to establish the communication session using the first telemetry protocol of the plurality of telemetry protocols by transmitting the telemetry initiation message using the first telemetry protocol; and after determining that the first attempt is unsuccessful based on the expiration of the predefined timeout without receiving the response from the surface acquisition module, performing a second attempt to establish the communication session using the second telemetry protocol of the plurality of telemetry protocols by transmitting the telemetry initiation message using the second telemetry protocol.

6. The method of claim 5, wherein:

dynamically attempting to establish the communication session comprises determining that the first attempt is unsuccessful; and the second attempt is performed in response to the determining that the first attempt is unsuccessful.

7. The method of claim 6, wherein the determining that the first attempt is unsuccessful comprises at least one of (i) detecting a timeout after an initiation of the first attempt or (ii) determining that a number of retries of the first attempt is greater than a threshold.

8. The method of claim 5, wherein dynamically attempting to establish the communication session further comprises, after determining that the second attempt is unsuccessful based on the expiration of the predefined timeout without receiving the response from the surface acquisition module, performing a third attempt to establish the communication session using a third telemetry protocol of the plurality of telemetry protocols by transmitting the telemetry initiation message using the third telemetry protocol.

9. The method of claim 8, wherein dynamically attempting to establish the communication session further comprises, after performing the third attempt and in response to determining that the third attempt is unsuccessful, re-performing the first attempt to establish the communication session using the first telemetry protocol.

10. The method of claim 1, wherein the surface acquisition module supports only a single telemetry protocol of the plurality of telemetry protocols and does not generate any response to the first and second communication attempts performed using the plurality of telemetry protocols other than the single telemetry protocol.

11. A downhole telemetry module comprising:

one or more memories collectively storing instructions; and one or more processors communicatively coupled to the one or more memories, the one or more processors being collectively configured to execute the instructions to cause the downhole telemetry module to:

determine a plurality of telemetry protocols supported by the downhole telemetry module for communications with a surface acquisition module;

without prior knowledge of which telemetry protocol of the plurality of telemetry protocols is supported by the surface acquisition module, dynamically attempt to establish a communication session with the surface acquisition module using one or more of the plurality of telemetry protocols by sequentially transmitting a telemetry initiation message using each telemetry protocol of the plurality of telemetry protocols;

determine, for each telemetry protocol, that a first telemetry protocol is unsupported based on an expiration of a predefined timeout without receiving a response from the surface acquisition module prior to transmitting the telemetry initiation message using a next telemetry protocol, wherein the surface acquisition module responds to second communication attempts performed using a second telemetry protocol supported by the surface acquisition module and refrains from responding to first communication attempts performed using unsupported telemetry protocols; and upon determining that an attempt with one of the plurality of telemetry protocols is successful, perform the communications with the surface acquisition module during the communication session using the one of the plurality of telemetry protocols.

12. The downhole telemetry module of claim 11, wherein to determine that the attempt with the one of the plurality of telemetry protocols is successful, the one or more processors are configured to execute the instructions to cause the downhole telemetry module to receive the response from the surface acquisition module within a predefined amount of time after initiation of the attempt, prior to a threshold number of retries of the attempt, or a combination thereof.

13. The downhole telemetry module of claim 12, wherein the surface acquisition module supports the one of the plurality of telemetry protocols and lacks support for each other telemetry protocol of the plurality of telemetry protocols.

14. The downhole telemetry module of claim 11, wherein to dynamically attempt to establish the communication session, the one or more processors are configured to execute the instructions to cause the downhole telemetry module to:

perform a first attempt to establish the communication session using the first telemetry protocol of the plurality of telemetry protocols; and after the performing the first attempt, perform a second attempt to establish the communication session using the second telemetry protocol of the plurality of telemetry protocols.

15. The downhole telemetry module of claim 14, wherein:

to dynamically attempt to establish the communication session, the one or more processors are configured to execute the instructions to cause the downhole telemetry module to determine that the first attempt is unsuccessful; and the second attempt is performed in response to determining that the first attempt is unsuccessful.

16. The downhole telemetry module of claim 15, wherein to determine that the first attempt is unsuccessful, the one or more processors are configured to execute the instructions to cause the downhole telemetry module to at least one of (i) detect a timeout after an initiation of the first attempt or (ii) determine that a number of retries of the first attempt is greater than a threshold.

17. The downhole telemetry module of claim 15, wherein to dynamically attempt to establish the communication session, the one or more processors are further configured to execute the instructions to cause the downhole telemetry module to, after performing the second attempt and in response to determining that the second attempt is unsuccessful, perform a third attempt to establish the communication session using a third telemetry protocol of the plurality of telemetry protocols.

18. The downhole telemetry module of claim 17, wherein to dynamically attempt to establish the communication session, the one or more processors are further configured to execute the instructions to cause the downhole telemetry module to, after performing the third attempt and in response to determining that the third attempt is unsuccessful, re-perform the first attempt to establish the communication session using the first telemetry protocol.

19. A non-transitory computer-readable storage medium comprising computer-executable code, which when executed by one or more processors of a downhole telemetry module, performs an operation comprising:

determining a plurality of telemetry protocols supported by the downhole telemetry module for communications with a surface acquisition module;

without prior knowledge of which telemetry protocol of the plurality of telemetry protocols is supported by the surface acquisition module, dynamically attempting to establish a communication session with the surface acquisition module using one or more of the plurality of telemetry protocols by sequentially transmitting a telemetry initiation message using each telemetry protocol of the plurality of telemetry protocols;

determining, for each telemetry protocol, that a first telemetry protocol is unsupported based on expiration of a predefined timeout without receiving a response from the surface acquisition module prior to transmitting the telemetry initiation message using a next telemetry protocol, wherein the surface acquisition module responds to second communication attempts performed using a second telemetry protocol supported by the surface acquisition module and refrains from responding to first communication attempts performed using unsupported telemetry protocols, wherein the surface acquisition module supports only a single telemetry protocol of the plurality of telemetry protocols and does not generate any response to the first and second communication attempts performed using telemetry protocols other than the single telemetry protocol; and upon determining that an attempt with the single telemetry protocol of the plurality of telemetry protocols is successful, performing the communications with the surface acquisition module during the communication session using the single telemetry protocol of the plurality of telemetry protocols.

* * * * *